US010513924B2

(12) United States Patent
Li et al.

(10) Patent No.: US 10,513,924 B2
(45) Date of Patent: Dec. 24, 2019

(54) INTELLIGENT AND FLEXIBLE STEEL ARCH PROTECTION DEVICE FOR ROCKFALL AND COLLAPSE OF TUNNELS

(71) Applicant: SHANDONG UNIVERSITY, Jinan, Shandong (CN)

(72) Inventors: Shucai Li, Jinan (CN); Zhenhao Xu, Jinan (CN); Xintong Wang, Jinan (CN); Xin Huang, Jinan (CN); Chunjin Lin, Jinan (CN); Dongdong Pan, Jinan (CN); Peng Lin, Jinan (CN)

(73) Assignee: SHANDONG UNIVERSITY, Jinan (CN)

( * ) Notice: Subject to any disclaimer, the term of this patent is extended or adjusted under 35 U.S.C. 154(b) by 0 days.

(21) Appl. No.: 16/072,086

(22) PCT Filed: Jan. 10, 2018

(86) PCT No.: PCT/CN2018/072077

§ 371 (c)(1),
(2) Date: Jul. 23, 2018

(87) PCT Pub. No.: WO2018/214518

PCT Pub. Date: Nov. 29, 2018

(65) Prior Publication Data

US 2019/0360334 A1 Nov. 28, 2019

(30) Foreign Application Priority Data

May 23, 2017 (CN) ..... 2017 1 03692436

(51) Int. Cl.
*E02D 11/00* (2006.01)
*E21D 11/00* (2006.01)
(Continued)

(52) U.S. Cl.
CPC ..... *E21D 11/003* (2013.01); *E21D 11/15* (2013.01); *E21D 11/18* (2013.01); *E21D 11/383* (2013.01); *E21D 11/40* (2013.01); *E21F 17/18* (2013.01)

(58) Field of Classification Search
CPC ..... E21D 11/003; E21D 11/15; E21D 11/18; E21D 11/383; E21D 11/40; E21F 17/18
See application file for complete search history.

(56) References Cited

U.S. PATENT DOCUMENTS 4,052,860 A * 10/1977 Alterman ..... E21D 11/006 405/259.5
4,271,407 A * 6/1981 Kehrman ..... E21F 17/185 324/207.16

(Continued)

FOREIGN PATENT DOCUMENTS

CN 102628368 A 8/2012
CN 204024678 U 12/2014

(Continued)

OTHER PUBLICATIONS

Mar. 23, 2018 International Search Report issued in International Patent Application No. PCT/CN2018/072077.

(Continued)

*Primary Examiner* — Benjamin F Fiorello
(74) *Attorney, Agent, or Firm* — Oliff PLC

(57) ABSTRACT

An intelligent and flexible steel arch protection device for rockfall and collapse of tunnels, including an arch main body system and a flexible protection system. The arch main body system includes an arched rigid high-strength steel frame and a base. The flexible protection system includes two parallel supporting rods which are oppositely arranged on the steel frame along the circular arc of the arch. Connecting rods are arranged between the two supporting rods at intervals, and the two ends of the connecting rods are fixed to the two supporting rods. The connecting rods are sleeved with guide rods and elastic devices are arranged between the guide rods and the supporting rods. A plurality of rolling shafts vertical to the axial direction of the two-way guide rods and connected with the two-way guide rods are arranged between the adjacent two-way guide rods, and the rolling shafts are sleeved with flexile rollers.

10 Claims, 2 Drawing Sheets

(51) Int. Cl.

| | |
|---|---|
| ***E21D 11/15*** | (2006.01) |
| *E21D 11/38* | (2006.01) |
| *E21F 17/18* | (2006.01) |
| *E21D 11/40* | (2006.01) |
| *E21D 11/18* | (2006.01) |

(56) References Cited

U.S. PATENT DOCUMENTS

| | | | | |
|---|---|---|---|---|
| 4,581,712 | A * | 4/1986 | Perry | G01L 5/243 299/1.05 |
| 4,915,542 | A | 4/1990 | Fernando | |
| 5,306,099 | A * | 4/1994 | Mason | E21D 19/04 405/291 |
| 5,584,608 | A * | 12/1996 | Gillespie | E21D 11/006 405/259.6 |
| 6,468,000 | B2 * | 10/2002 | McNally | E21D 9/0692 405/146 |
| 6,955,502 | B2 * | 10/2005 | Warren | E21D 11/38 264/32 |
| 9,291,053 | B2 * | 3/2016 | Li | E21D 11/10 |
| 2008/0041377 | A1 * | 2/2008 | Turiello | E21F 11/00 128/204.18 |
| 2014/0320298 | A1 * | 10/2014 | Meiksin | G01N 29/14 340/683 |
| 2018/0089852 | A1 * | 3/2018 | Baker | G06T 7/60 |

FOREIGN PATENT DOCUMENTS

| | | | |
|---|---|---|---|
| CN | 205243522 | U | 5/2016 |
| CN | 205840893 | U | 12/2016 |
| CN | 206000552 | U | 3/2017 |
| CN | 107035390 | A | 8/2017 |

OTHER PUBLICATIONS

Mar. 23, 2018 Written Opinion of the International Searching Authority issued in International Patent Application No. PCT/CN2018/072077.

* cited by examiner

INTELLIGENT AND FLEXIBLE STEEL ARCH PROTECTION DEVICE FOR ROCKFALL AND COLLAPSE OF TUNNELS

FIELD OF THE INVENTION

The embodiments herein relate to an intelligent and flexible steel arch protection device for rockfall and collapse of tunnels.

BACKGROUND OF THE INVENTION

Due to a rapid development of economic construction, a large number of major foundation projects such as water conservancy and hydropower projects, and railway and highway traffic projects, have accelerated the pace of construction, the focus of construction has shifted to the mountainous and karst areas in the western regions where the terrain and geological conditions are extremely complicated. This greatly promotes the construction of tunnel projects. In order to improve the stability of surrounding rocks and the construction safety during tunnel construction with karst caves, weak surrounding rocks usually require arch support installation. After the initial support of the construction of karst tunnels, and before the construction of the second lining, collapse of the tunnels often cause irreparable damage to the arch frame, resulting in serious casualties, delays of construction periods, and economic losses. Experts and scholars have not yet developed an effective arch protection measure or device for the rockfall and collapse disasters of tunnels containing karst caves. Therefore, it is necessary to invent an arch flexible protection device and early warning system for rockfall and collapse of tunnels containing karst caves and in underground constructions so that construction units can grasp the information of collapse accurately in time and take emergency measures as soon as possible to reduce losses.

SUMMARY OF THE INVENTION

In order to overcome the deficiencies of the above technology, the present invention provides an intelligent and flexible steel arch protection device for rockfall and collapse of tunnels that is of simple operation and convenient monitoring.

In order to achieve the above objectives, the present invention adopts the following technical solutions:

An intelligent and flexible steel arch protection device for rockfall and collapse of tunnels includes an arch main body system and a flexible protection system. The arch main body system includes an arched, rigid, high-strength steel frame and a base. The flexible protection system includes two parallel supporting rods which are oppositely arranged on the rigid high-strength steel frame along the circular arc of the arch. Connecting rods are arranged between the two supporting rods at intervals, with the two ends of the connecting rods are fixed to the two supporting rods. The connecting rods are sleeved with guide rods, and elastic devices are arranged between the guide rods and the supporting rods. A plurality of rolling shafts vertical to the axial direction of the two-way guide rods and connected with the two-way guide rods are arranged between the adjacent two-way guide rods, and the rolling shafts are sleeved with flexile rollers.

The supporting rod is connected with the rigid high-strength steel frame through an upright post, and a buffering and damping block is arranged on the upright post.

The flexible protection system further includes a fence type rockfall barrier. The fence type rockfall barrier is arranged at the top of the rigid high-strength steel frame and is located below the flexible roller.

A plurality of flexile rollers are embedded in the parallel rolling shafts. The flexile rollers and the rolling shafts are connected by bearings and are coated with lubricating oil. Gaps exist between the flexile rollers on different rolling shafts and the flexile rollers can roll without resistance.

Elastic devices are arranged between the two-way guide rods. The elastic device is a high-strength spring.

The intelligent and flexible steel arch protection device further includes an intelligent monitoring and data collection system including a plurality of sensors, a wireless transmission device, and a rotating speed sensor and a pressure sensor that are arranged in the flexile roller to detect information about the pressures, the number of revolutions, the rotating speed, the angle and the angular speed of the flexile roller and a main shaft.

The wireless transmission device is embedded in the flexile roller and a collected signal is transmitted to a data analysis and feedback system through the wireless transmission device.

The intelligent and flexible steel arch protection device further includes the data analysis and feedback system, which includes a computer, a servo controller and a remote control room. The data analysis and feedback system is responsible for storing, sorting, processing and analyzing data collected by the intelligent monitoring system so as to achieve fully automatic processing.

The data analysis and feedback system analyzes the monitoring data, provides early warning and forecasts for different types of collapse, and feeds back the data to an alarm system so that construction units can understand the collapse information accurately in time and take emergency measures as soon as possible to reduce the losses.

When rockfall with a huge impact force falls downward, a part of the impact kinetic energy is counteracted by the deformation of the flexible roller and is converted into deformation potential energy. The rebound force generated after the deformation of the flexible roller can react to the rockfall, thereby greatly reducing the damage of the rockfall and collapse to the arch. After the collapse occurs, the flexible roller is rotated by lateral force, and the remaining part of the impact kinetic energy is converted into rotational kinetic energy. The generated rotation of the flexible roller has a guiding effect on the rockfall so that the impact force of the rockfall itself is reduced along the direction of the arch and the damage of the rockfall and collapse to the arch is further reduced.

The anti-impact buffering system of the present application is divided into two types of damping and buffering devices, namely, a high-strength spring and a buffering and damping cushion block. The high-strength spring is fixed between the guide rod and a vertical rod and between the guide rod and the guide rod.

The intelligent monitoring and data collection system includes a plurality of sensors and a wireless transmission device. A rotating speed sensor and a pressure sensor are arranged in the flexile roller, the wireless transmission device is embedded in the flexile roller and the collected signal is transmitted to the data analysis and feedback system through the wireless transmission device.

The data analysis and feedback system includes the computer, the servo controller and the remote control room and is responsible for storing, sorting, processing and analyzing data collected by the intelligent monitoring system so as to achieve fully automatic processing.

The arch main body system includes the rigid high-strength steel frame and the base. The arch main body can set steel arch parameters according to the specific conditions of the tunnel. The supporting rods and the connecting rods are connected by bolts to form the steel frame, which is divided into upper-layer and lower-layer frames. The upper and lower layers are detachable for repeated use. The plurality of flexile rollers are embedded in the parallel rolling shafts, with the flexile rollers and the rolling shafts are connected by bearings and are coated with lubricating oil. Gaps exist between the flexile rollers on different rolling shafts. The flexile rollers can roll without resistance and are fixed on the first layer of frame to form first layer protection.

The fence type rockfall barrier is a cable wire protection net, which is fixed to the second layer of frame to form a second layer protection. When rocks fall downward with a huge impact force, a part of the impact kinetic energy is counteracted by the deformation of the flexible roller and is converted into deformation potential energy. The rebound force generated after the deformation of the flexible roller can react to the rockfall, thereby greatly reducing the damage of the rockfall and collapse to the arch.

After the collapse occurs, the flexible roller is rotated by the lateral force, and the remaining part of the impact kinetic energy is converted into rotational kinetic energy. The generated rotation of the flexible roller has a guiding effect on the rockfall so that the impact force of the rockfall itself is reduced along the direction of the arch and the damage of the rockfall and collapse to the arch is further reduced.

The anti-impact buffering system is divided into two types of damping and buffering devices, namely, the high-strength spring and the buffering and damping cushion block.

The high-strength spring is fixed between the guide rod and a vertical rod, and between the guide rod and the guide rod. When the impact energy of rockfall is large, the rotational kinetic energy of the flexible roller and the deformation potential energy of the flexible roller are insufficient for counteraction, the high-strength spring is stretched or compressed, and the horizontal impact kinetic energy is converted into the elastic potential energy of the spring.

The buffering and damping cushion block is made of rubber and is disposed between the upper-layer and lower-layer frames so as to counteract the vertical impact kinetic energy generated by the rockfall.

The present embodiments present an intelligent and flexible steel arch protection device and an early warning system for rockfall and collapse of tunnels, which are suitable for tunnel surrounding rocks containing karst caves. The present embodiments reduce the threat of collapse and rockfall disasters of the karst caves with respect to the steel arch in the original karst tunnel construction. The present embodiments solve the technical problem of real-time and accurate monitoring of the collapse and rockfall disasters of the karst caves. Compared with the previous studies, the device of the present embodiments have the following advantages:

1) The supporting rods and the guide rods are connected by bolts to form the steel frame, which is divided into upper-layer and lower-layer frames. The upper and lower layers are detachable, thereby being reusable, economic, and convenient.

2) A part of the impact kinetic energy is counteracted by the deformation of the flexible roller and is converted into deformation potential energy, the remaining part is converted into the rotational kinetic energy, and the dual protection layers formed by the flexible roller and the fence type rockfall barrier perform dual protection on the arch so that the safety is higher.

3) The device has a guiding effect on the rockfall. The rebound force generated after the deformation of the flexible roller can react to the rockfall so that the impact force of the rockfall itself is reduced along the direction of the arch and the damage of the rockfall and collapse to the arch is also reduced;

4) The anti-impact buffering system is composed of two types of damping and buffering devices, the high-strength spring and the buffering and damping cushion block respectively buffer the impact on the vertical direction and the horizontal direction, and the device is convenient but is not simple.

5) The intelligent monitoring and data collection system detects the pressure, the number of revolutions, the rotating speed, the angle and the angular speed and other information of the flexile roller and the main shaft and performs wireless transmission so that the occurrence of rockfall can be accurately monitored with high comprehensiveness.

6) The data analysis and feedback system is responsible for storing, sorting, processing and analyzing data collected by the intelligent monitoring system so as to achieve fully automatic processing. Early warning and forecast are performed on different kinds of collapse and are fed back to the alarm system efficiently and accurately. In addition, guiding suggestions are provided for specific construction.

BRIEF DESCRIPTION OF THE DRAWINGS

The drawings constitute a part of the present application and are used for providing a further understanding of the present application. The exemplary embodiments of the present application and the descriptions thereof are used for explaining the present application and do not constitute improper limitations to the present application.

REFERENCE SIGNS

Figure 1:
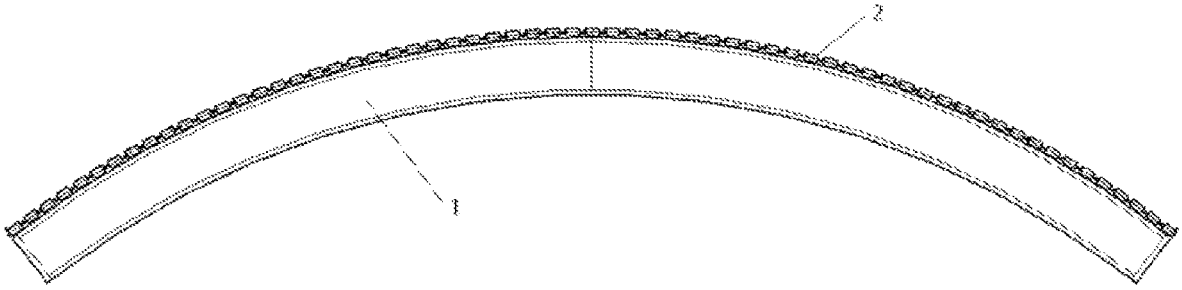
FIG. 1 is a front view of a structure of an embodiment.
Figure 2:
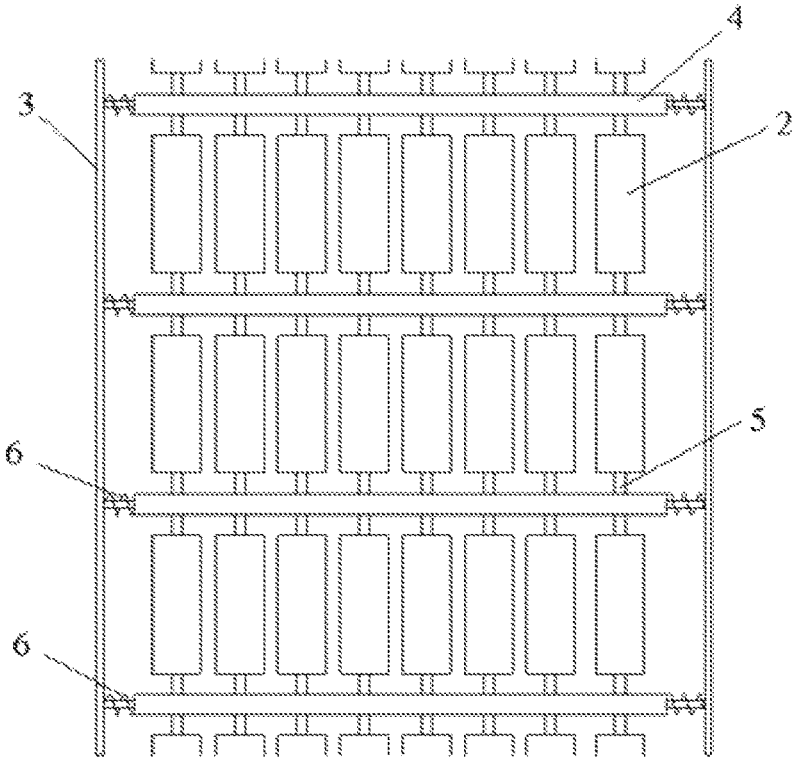
FIG. 2 is a schematic diagram of a top view of a flexible protection system.
Figure 3:
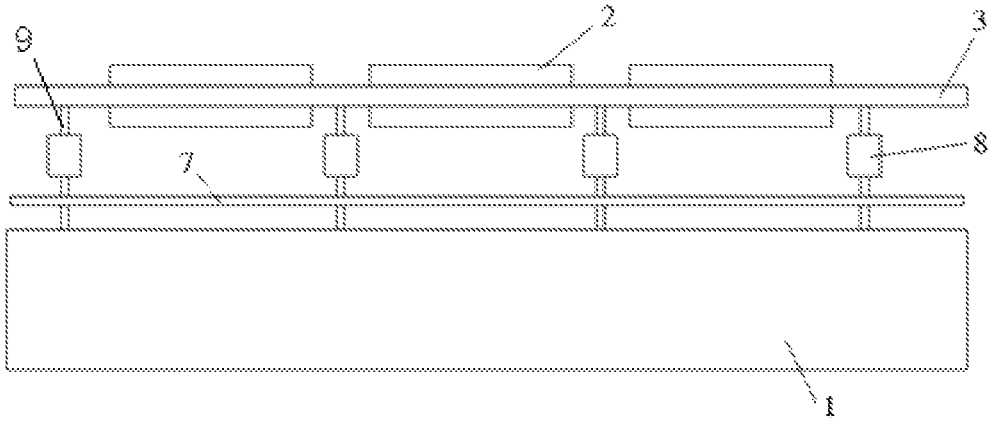
FIG. 3 is a schematic diagram of a front view of the flexible protection system.

1 high-strength steel frame; 2 flexible roller; 3 arched supporting rod; 4 two-way guide rod and assorted slide bar; 5 parallel rolling shafts; 6 high-strength spring; 7 fence type rockfall barrier; 9 buffering and damping cushion block, 9 rigid vertical rod, and 10 connecting rod.

DETAILED DESCRIPTION OF EMBODIMENTS

It should be noted that the following detailed description is illustrative and is intended to provide further explanation of the present application. Unless otherwise indicated, all technical and scientific terms used herein have the same meaning as commonly understood by those of ordinary skill in the art to which the present application belongs.

It should be noted that the terms used herein are merely used for describing specific embodiments and are not intended to limit the exemplary embodiments according to the present application. As used herein, the singular forms are also intended to include the plural forms, unless otherwise clearly indicated in the context, and it also should be understood that when the terms "contain" and/or "include"

are used in the present specification, the terms indicate the presence of features, steps, operations, devices, components, and/or combinations thereof.

The "high strength" in the present embodiment means that the strength can withstand the impact force of the rockfall. The fence type rockfall barrier refers to a mesh structure formed by braiding steel strands.

As described in the technical background of the invention, after the initial support of the construction of tunnels and before the construction of the second lining, the occurring collapse and rockfall disasters often cause irreparable damage to the erected arches, resulting in serious casualties, delays of construction periods and economic losses. In order to solve the above technical problems, the present application provides an intelligent and flexible steel arch protection device and early warning system for rockfall and collapse of tunnels.

Specific implementations of the present application are further illustrated in detail below in combination with the accompanying drawings.

In the intelligent and flexible steel arch protection device and early warning system for rockfall and collapse of tunnels, an arch main body system includes a rigid high-strength steel frame 1 and a base. Specific steel arch frame parameters can be set according to specific conditions of the tunnel.

A flexible protection system includes a plurality of flexible rollers 2, arched supporting rods 3, two-way guide rods and assorted slide bars 4, parallel rolling shafts 5 and a fence type rockfall barrier 7. The supporting rods 3 and the connecting rods 10 are connected by bolts to form a steel frame, which is divided into upper-layer and lower-layer frames. The upper and lower layers are detachable for repeated use. The plurality of flexile rollers 2 are embedded in each parallel rolling shaft 5. The flexile rollers and the rolling shafts are connected by bearings and are coated with lubricating oil. Gaps exist between the flexile rollers on different rolling shafts, the flexile rollers can roll without resistance and are fixed on the first layer of frame to form first layer protection. The fence type rockfall barrier 7 is a cable wire protection net that is fixed to the second layer of frame to form second layer protection.

Large rockfall is intercepted by the first layer protection and small rolling rocks passing through the double-layer rigid frame pores are intercepted by the second layer protection.

The fence type rockfall barrier is composed of a high-strength bottom frame and a steel strand rockfall barrier. The impact energy of small rockfall is converted into the deformation energy of the rockfall barrier.

The arched supporting rods 3 are connected with the rigid high-strength steel frame 1 by rigid vertical rods.

When rockfall with a huge impact force falls downward, a part of the impact kinetic energy is counteracted by the deformation of the flexible roller 1 and is converted into deformation potential energy. The rebound force generated after the deformation of the flexible roller can react to the rockfall, thereby greatly reducing the damage of the rockfall and collapse to the arch. After the collapse occurs, the flexible roller is rotated by the lateral force. The remaining part of the impact kinetic energy is converted into rotational kinetic energy, and the generated rotation of the flexible roller has a guiding effect on the rockfall so that the impact force of the rockfall itself is reduced along the direction of the arch and the damage of the rockfall and collapse to the arch is further reduced.

The anti-impact buffering system is divided into two types of damping and buffering devices, namely, a high-strength spring 6 and a buffering and damping cushion block 8. The high-strength spring 6 is fixed between the guide rods 4 and the arched supporting rods 3. When the impact energy of rockfall is large, the rotational kinetic energy of the flexible roller 2 and the deformation potential energy of the flexible roller are insufficient for counteraction, the high-strength spring 6 is stretched or compressed, and the horizontal impact kinetic energy is converted into the elastic potential energy of the spring. The buffering and damping cushion block 8 is made of rubber and is disposed between the upper and lower frames so as to counteract the vertical impact kinetic energy generated by the rockfall.

An intelligent monitoring and data collection system includes a plurality of sensors and a wireless transmission device. A rotating speed sensor and a pressure sensor are arranged in the flexile roller for detecting information about the pressure, the number of revolutions, the rotating speed, and the angle and the angular speed of the flexile roller and a main shaft. The wireless transmission device is embedded in the flexile roller, and a collected signal is transmitted to a data analysis and feedback system through the wireless transmission device.

The data analysis and feedback system includes a computer, a servo controller and a remote control room. The data analysis and feedback system is responsible for storing, sorting, processing and analyzing data collected by the intelligent monitoring system so as to achieve fully automatic processing. The data analysis and feedback system analyzes the monitoring data, provides early warning and forecast for different types of collapse, and feeds back the data to an alarm system so that construction units can understand the collapse information accurately in time and take emergency measures as soon as possible to reduce the losses.

The anti-impact buffering system of the present application is divided into two types of damping and buffering devices, namely, the high-strength spring and the buffering and damping cushion block. The high-strength spring is fixed between the guide rod and the vertical rod and between the guide rod and the guide rod.

The intelligent monitoring and data collection system includes a plurality of sensors and a wireless transmission device. The rotating speed sensor and the pressure sensor are arranged in the flexile roller, the wireless transmission device is embedded in the flexile roller, and the collected signal is transmitted to the data analysis and feedback system through the wireless transmission device.

The data analysis and feedback system includes the computer, the servo controller, and the remote control room. The data analysis system is responsible for storing, sorting, processing and analyzing data collected by the intelligent monitoring system so as to achieve fully automatic processing.

The arch main body system includes the rigid high-strength steel frame and the base, and specific steel arch frame parameters can be set according to specific conditions of the tunnel.

The supporting rods and the connecting rods are connected by bolts to form the steel frame, which is divided into upper-layer and lower-layer frames. The upper and lower layers are detachable for repeated use.

The plurality of flexile rollers are embedded in the parallel rolling shafts. The flexile rollers and the rolling shafts are connected by bearings and are coated with lubricating oil. Gaps exist between the flexile rollers on different rolling shafts, and the flexile rollers can roll without resistance and are fixed on the first layer of frame to form first layer protection.

The fence type rockfall barrier is the cable wire protection net, which is fixed to the second layer of frame to form second layer protection.

When the rockfall with the huge impact force falls downward, a part of the impact kinetic energy is counteracted by the deformation of the flexible roller and is converted into deformation potential energy. The rebound force generated after the deformation of the flexible roller can react to the rockfall, thereby greatly reducing the damage of the rockfall and collapse to the arch.

After the collapse occurs, the flexible roller is rotated by the lateral force, and the remaining part of the impact kinetic energy is converted into rotational kinetic energy. The generated rotation of the flexible roller has a guiding effect on the rockfall so that the impact force of the rockfall itself is reduced along the direction of the arch and the damage of the rockfall and collapse to the arch is further reduced.

The anti-impact buffering system is divided into two types of damping and buffering devices, namely, the high-strength spring and the buffering and damping cushion block.

The high-strength spring is fixed between the guide rod and the vertical rod and between the guide rod and the guide rod. When the impact energy of rockfall is large, the rotational kinetic energy of the flexible roller and the deformation potential energy of the flexible roller are insufficient for counteraction, the high-strength spring is stretched or compressed, and the horizontal impact kinetic energy is converted into the elastic potential energy of the spring.

The buffering and damping cushion block is made of rubber and is disposed between the upper-layer and lower-layer frames so as to counteract the vertical impact kinetic energy generated by the rockfall.

Although specific embodiments of the present invention have been described above with reference to the drawings, the protection scope of the present invention is not limited thereto. Those skilled in the art should understand that, based on the technical solutions of the present invention, various modifications or variations that can be made by those skilled in the art without any creative work still fall within the protection scope of the present invention.

The invention claimed is:

1. An intelligent and flexible steel arch protection device for rockfall and collapse of tunnels, comprising:

an arch main body system and a flexible protection system;

the arch main body system including an arched rigid high-strength steel frame and a base;

the flexible protection system includes two parallel supporting rods which are oppositely arranged on the rigid high-strength steel frame along the circular arc of the arch, connecting rods are arranged between the two supporting rods at intervals, the two ends of the connecting rods are fixed to the two supporting rods, the connecting rods are sleeved with guide rods, and elastic devices are arranged between the guide rods and the supporting rods; and a plurality of rolling shafts vertical to the axial direction of the two-way guide rods and connected with the two-way guide rods are arranged between the adjacent two-way guide rods, and the rolling shafts are sleeved with flexile rollers.

2. The intelligent and flexible steel arch protection device for rockfall and collapse of tunnels according to claim 1, wherein:

the supporting rod is connected with the rigid high-strength steel frame through an upright post, and a buffering and damping block is arranged on the upright post.

3. The intelligent and flexible steel arch protection device for rockfall and collapse of tunnels according to claim 1, wherein the connecting rods and the supporting rods are connected by bolts.

4. The intelligent and flexible steel arch flexible protection device for rockfall and collapse of tunnels according to claim 1, wherein the flexible protection system further includes a fence type rockfall barrier arranged at the top of the rigid high-strength steel frame and located below the flexible roller.

5. The intelligent and flexible steel arch protection device for rockfall and collapse of tunnels according to claim 1, wherein:

a plurality of flexile rollers is embedded in the parallel rolling shafts, the flexile rollers and the rolling shafts being connected by bearings and coated with lubricating oil, gaps exist between the flexile rollers on different rolling shafts, and the flexile rollers can roll without resistance.

6. The intelligent and flexible steel arch protection device for rockfall and collapse of tunnels according to claim 1, wherein elastic devices are also arranged between the two-way guide rods.

7. The intelligent and flexible steel arch protection device for rockfall and collapse of tunnels according to claim 1, wherein each elastic device of the elastic devices is a high-strength spring.

8. The intelligent and flexible steel arch protection device for rockfall and collapse of tunnels according to claim 1, further comprising:

an intelligent monitoring and data collection system, wherein the intelligent monitoring and data collection system includes a plurality of sensors and a wireless transmission device, and a rotating speed sensor and a pressure sensor arranged in the flexile roller for detecting information about pressure, the number of revolutions, the rotational speed, angle, and angular speed of the flexile roller and a main shaft; and the wireless transmission device is embedded in the flexile roller, and a collected signal is transmitted to a data analysis and feedback system through the wireless transmission device.

9. The intelligent and flexible steel arch protection device for rockfall and collapse of tunnels according to claim 1, further comprising a data analysis and feedback system including a computer, a servo controller and a remote control room, the data analysis and feedback system being responsible for storing, sorting, processing and analyzing data collected by the intelligent monitoring system so as to achieve fully automatic processing.

10. The intelligent and flexible steel arch protection device for rockfall and collapse of tunnels according to claim 1, wherein specific steel arch parameters of the rigid high-strength steel frame and the base can be set according to specific conditions of the tunnel.

* * * * *